US007862370B1

(12) United States Patent
Chen

(10) Patent No.: US 7,862,370 B1
(45) Date of Patent: Jan. 4, 2011

(54) CONNECTOR FOR STURDILY CONNECTING FLEXIBLE CIRCUIT BOARDS

(75) Inventor: Yen-Lin Chen, Wugu Township, Taipei County (TW)

(73) Assignee: Taiwan Suncagey Industrial Co., Ltd., Taipei County (TW)

( * ) Notice: Subject to any disclaimer, the term of this patent is extended or adjusted under 35 U.S.C. 154(b) by 0 days.

(21) Appl. No.: 12/614,045

(22) Filed: Nov. 6, 2009

(51) Int. Cl.
*H01R 12/24* (2006.01)

(52) U.S. Cl. ..... 439/495; 439/492; 439/329

(58) Field of Classification Search ..... 439/729, 439/492, 495, 329, 260
See application file for complete search history.

(56) References Cited

U.S. PATENT DOCUMENTS 7,094,093 B2 * 8/2006 Nakano et al. ..... 439/495
7,416,438 B2 * 8/2008 Hashiguchi et al. ..... 439/495

* cited by examiner

*Primary Examiner*—Javaid Nasri
(74) *Attorney, Agent, or Firm*—Leong C. Lei

(57) ABSTRACT

A connector includes a housing, a flexible circuit board, a terminal and a pressing element. The flexible circuit board, two sides of which are formed respectively with a latching part, is electrically connected with the connector. The terminal includes a movable arm and a fixed arm which are extended toward a same direction and parallel provided. An end of the movable arm is a pushing part, and the other end is a pushed part. The fixed arm is fixed by using the housing and includes a snap part close to the pushing part. The pressing element has an abutting part to push the pushed part. Accordingly, when the pressing element is acted upon by a displacement operation to displace toward a pre-determined direction, the snap part of the fixed arm is engaged into the latching part of the flexible circuit board which is therefore effectively fixed at the connector.

1 Claim, 9 Drawing Sheets

CONNECTOR FOR STURDILY CONNECTING FLEXIBLE CIRCUIT BOARDS

BACKGROUND OF THE INVENTION a) Field of the Invention

The present invention relates to a connector which is used for electrically connecting a flexible circuit board, and more particularly to a connector which is able to fix a flexible circuit board effectively.

b) Description of the Prior Art

To enable a flexible circuit board achieving an electric connection effect, this kind of flexible circuit board will usually be connected to a connector which includes a housing, a terminal and a pressing element. When the pressing element of the connector is operated, the pressing element can operate the terminal, allowing the terminal to be pressed onto the flexible circuit board.

Nevertheless, the aforementioned connector has already been a very well-known technology and there is a vendor who develops a connector which can prevent a user from pulling the flexible circuit board, resulting in that the flexible circuit board falls off. Referring to FIG. 1 and FIG. 2, it shows a first and second schematic view of an implementation of a conventional connector. As shown in the drawings, a conventional connector 1 includes a housing 11, a terminal 12, a pressing element 13 and a flexible circuit board 14. The terminal 12 includes a fixed arm 121 and a movable arm 122 which are extended toward a same direction and are parallel provided. The fixed arm 121 is fixed on the housing 11, an end of the movable arm 122 is provided with a snap part 123 and the other end is provided with a pushed part 124. The fixed arm 121 and the movable arm 122 are connected as one unit using a connection part 125, and the pressing element 13 is provided with a cam 131; whereas, two sides of the flexible circuit board 14 are provided with respectively with a latching part 141.

As shown in FIG. 2, when the flexible circuit board 14 is inserted into the connector 1, a force is exerted onto the pressing element 13, such that the pressing element 13 can be displaced toward a pre-determined direction. The cam 131 of the pressing element 13 will then push up the pushed part 124 and the movable arm 122 will make an angular displacement using the connection part 125 as a pivot, allowing the cam 131 of the pressing element 13 to abut at the pushed part 124 of the movable arm 122. As a result, the movable arm 122 can be effectively limited and fixed, allowing the snap part 123 to be fixed and accommodated in the latching part 141 of the flexible circuit board 14. Accordingly, if the flexible circuit board 14 is pulled, the flexible circuit board 14 can be prevented from falling off from the connector 1 by engaging the snap part 123 into the latching part 141.

However, when the aforementioned connector 1 is used, following issues and shortcomings actually exist to be improved.

As shown in FIG. 1, as the snap part 123 is provided at one end of the movable arm 122 of the connector 1, when the flexible circuit board 14 is inserted into the connector 1, the flexible circuit board 14 will not be easily inserted due to blocking of the snap part 123, and this really needs to be improved.

Therefore, how to solve the aforementioned issues and shortcomings of the prior art is a direction of research and development for improvement by the present inventor and related vendors.

SUMMARY OF THE INVENTION

The primary object of the present invention is to provide a connector which enables a flexible circuit board to be connected more sturdily.

To achieve the aforementioned object, the connector of the present invention includes a housing, a flexible circuit board, a terminal and a pressing element. The flexible circuit board provides for electric connection with the connector, and two sides of the flexible circuit board are formed respectively with a latching part. The terminal includes a movable arm and a fixed arm which are extended toward a same direction and are parallel provided. An end of the movable arm is provided with a pushing part and the other end is provided with a pushed part. The fixed arm is fixed by using the housing and is formed with a snap part close to the pushing part; whereas, the pressing element is provided with an abutting part which can push the pushed part.

As the fixed arm is formed with the snap part close to the pushing part, and two sides of the flexible circuit board are formed respectively with the latching part, when the pressing element displaces toward a pre-determined direction by being acted upon by a displacement operation, the abutting part of the pressing element can push the pushed part of the movable arm, allowing the movable arm to make an angular displacement, which further enables the flexible circuit board to displace downward, such that the snap part of the fixed arm can be engaged into the latching part of the flexible circuit board. Accordingly, after the connector has been connected with the flexible circuit board, the flexible circuit board will not fall off easily by being touched mistakenly. The present invention enables the flexible circuit board to be connected with the connector more sturdily. In addition, upon inserting the flexible circuit board, the insertion of the flexible circuit board will not be blocked by the snap part of the fixed arm, which is provided with the practical progressiveness.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
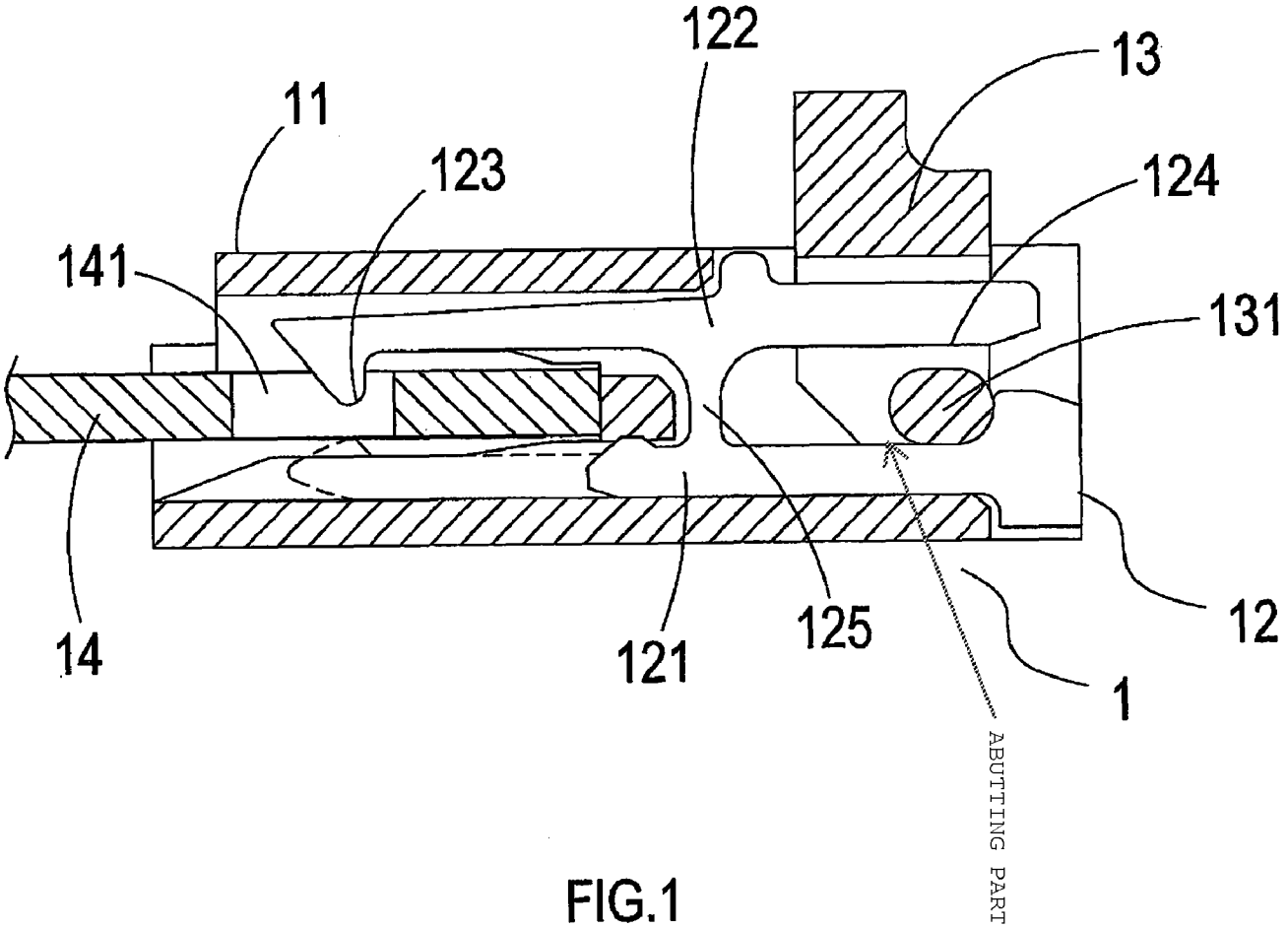
FIG.1 Prior Art
FIG. 1 shows a first schematic view of an implementation of a conventional connector.
Figure 2:
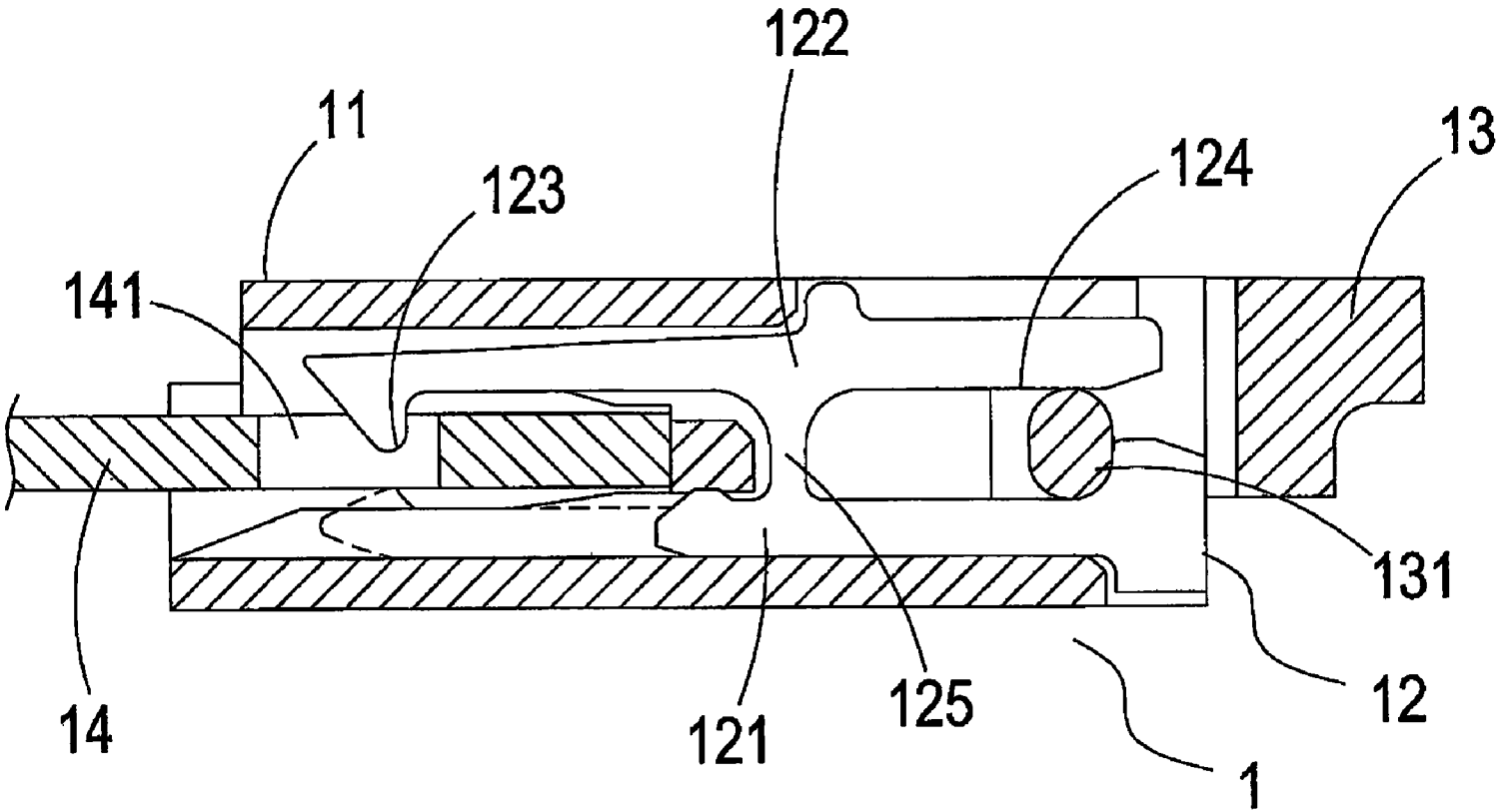
FIG.2 Prior Art
FIG. 2 shows a second schematic view of the implementation of the conventional connector.
Figure 3:
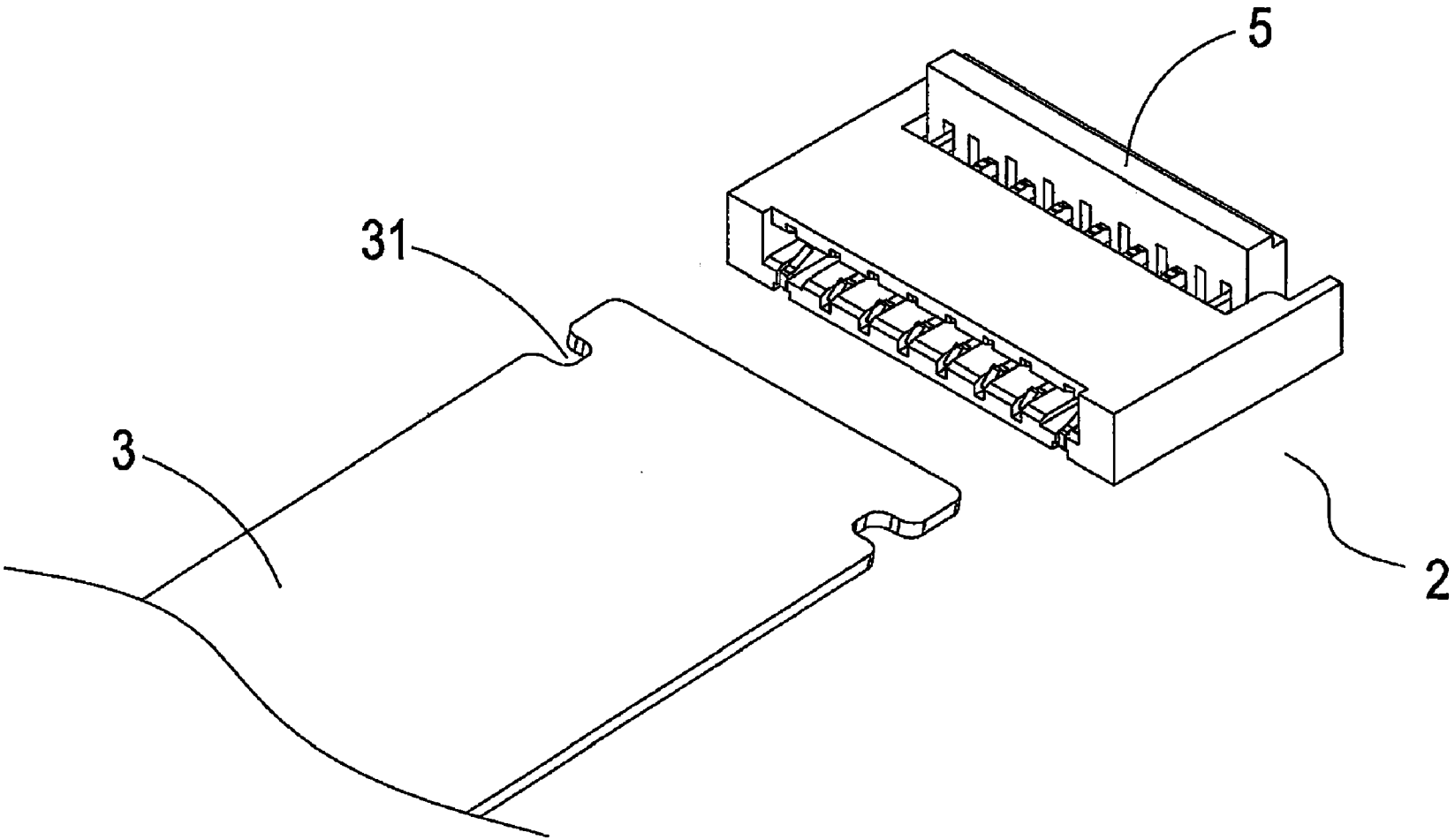
FIG. 3 shows a three-dimensional schematic view of a preferred embodiment of the present invention.
Figure 4:
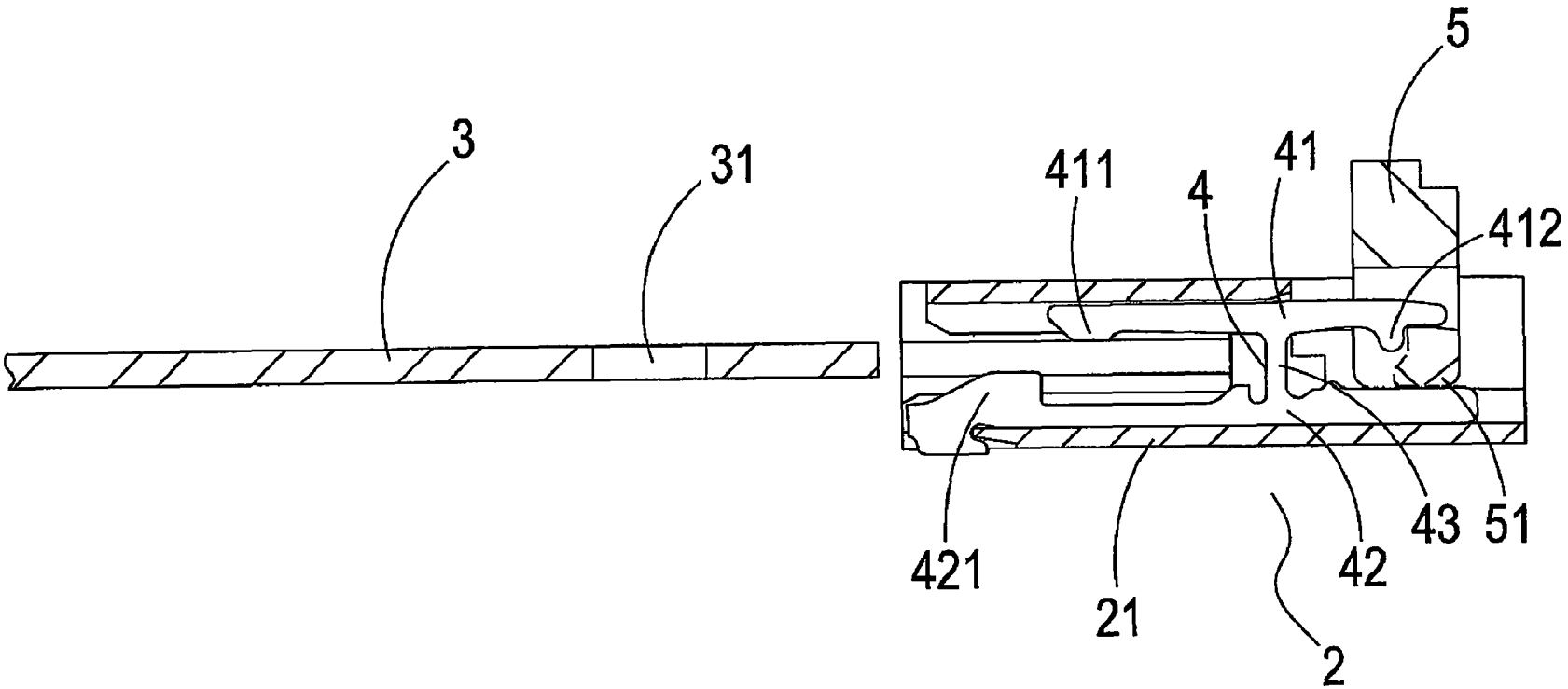
FIG. 4 shows a cutaway view of the preferred embodiment of the present invention.

Referring to FIG. 3 and FIG. 4, it shows a three-dimensional schematic view and a cutaway view, of a preferred embodiment of the present invention. As shown in the drawings, a connector 2 of the present invention comprises:

a housing 21;

a flexible circuit board 3, which provides for electric connection with the connector 2 and two sides of which are formed respectively with a latching part 31;

a terminal 4, which is provided with a movable arm 41 and a fixed arm 42, with both arms being extended toward a same direction and parallel provided, wherein an end of the movable arm 41 is provided with a pushing part 411, the other end is provided with a pushed part 412, the fixed arm 42 is fixed by using the housing 21 and is formed with a snap part 421 close to the pushing part 411, and the movable arm 41 and the fixed arm 42 are formed as one unit by using a connection part 43; and a pressing element 5, which is provided with an abutting part 51 able to push the pushed part 412.

When the pressing element 5 is acted upon by a displacement operation to displace toward a pre-determined direction, the abutting part 51 of the pressing element 5 can push the pushed part 412 of the movable arm 41, allowing the movable arm 41 to make an angular displacement using the connection part 43 as a pivot, which further enables the flexible circuit board 3 to displace downward, such that the snap part 421 of the fixed arm 42 can be engaged into the latching part 31 of the flexible circuit board 3.

Figure 5:
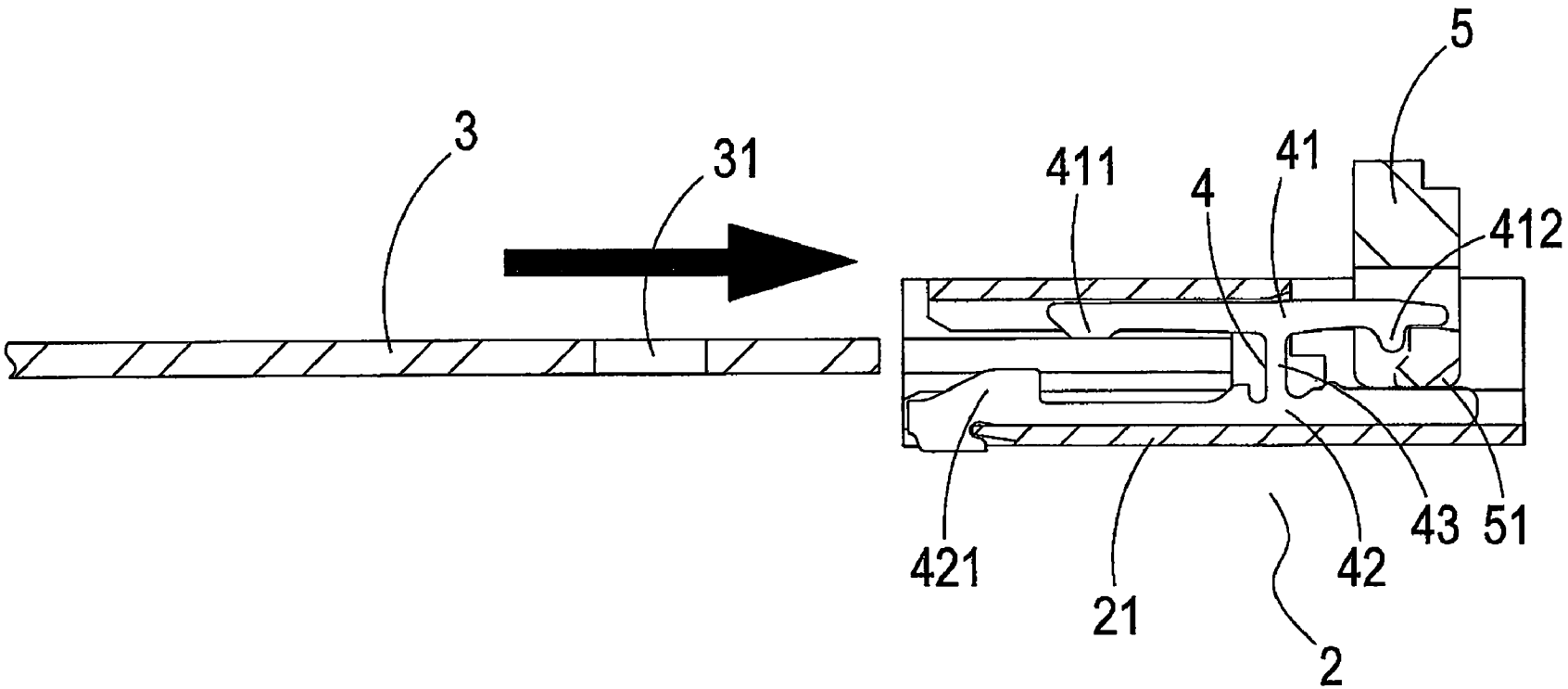
FIG. 5 shows a first schematic view of the implementation of the preferred embodiment of the present invention.
Figure 6:
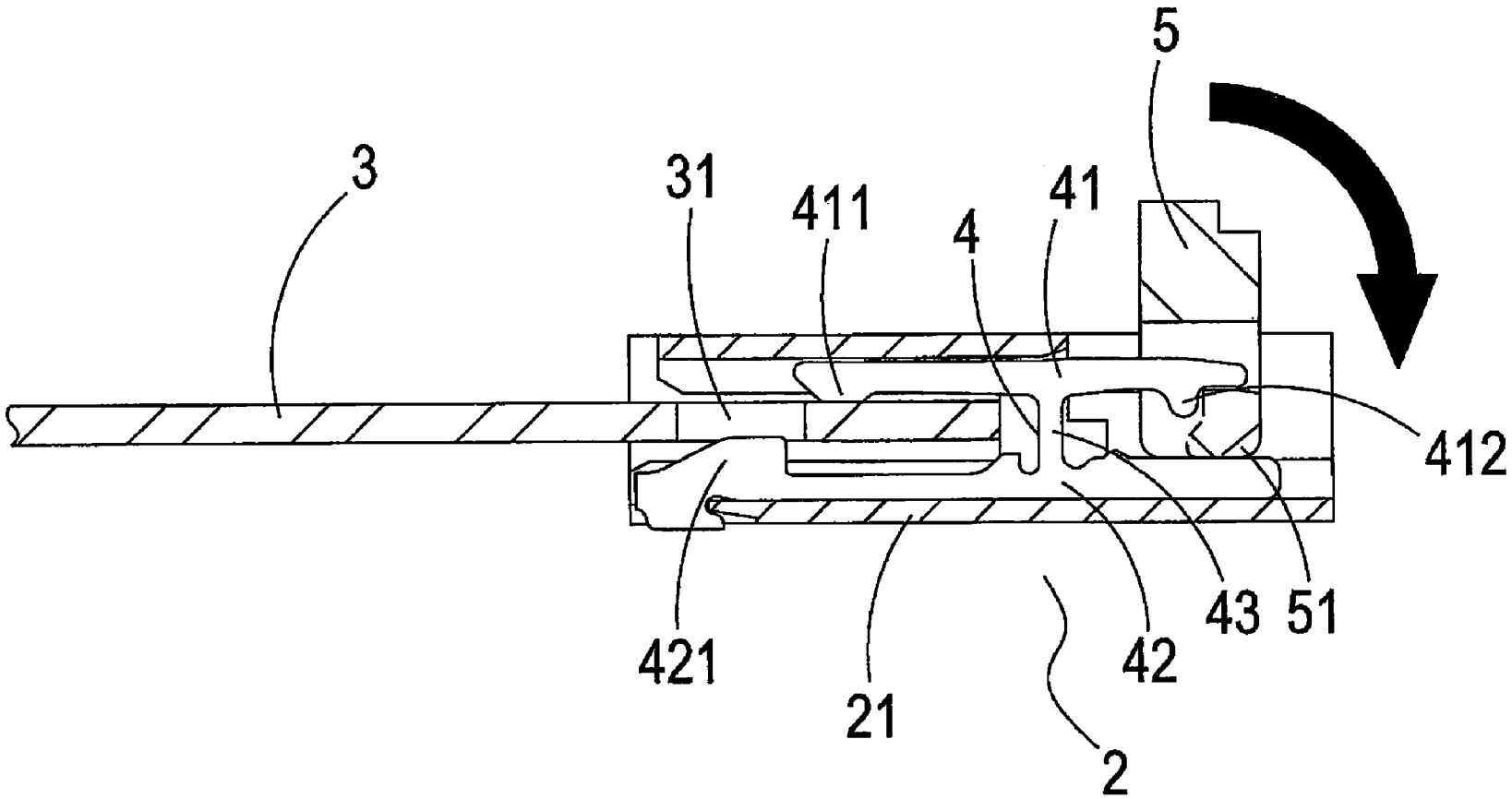
FIG. 6 shows a second schematic view of the implementation of the preferred embodiment of the present invention.
Figure 7:
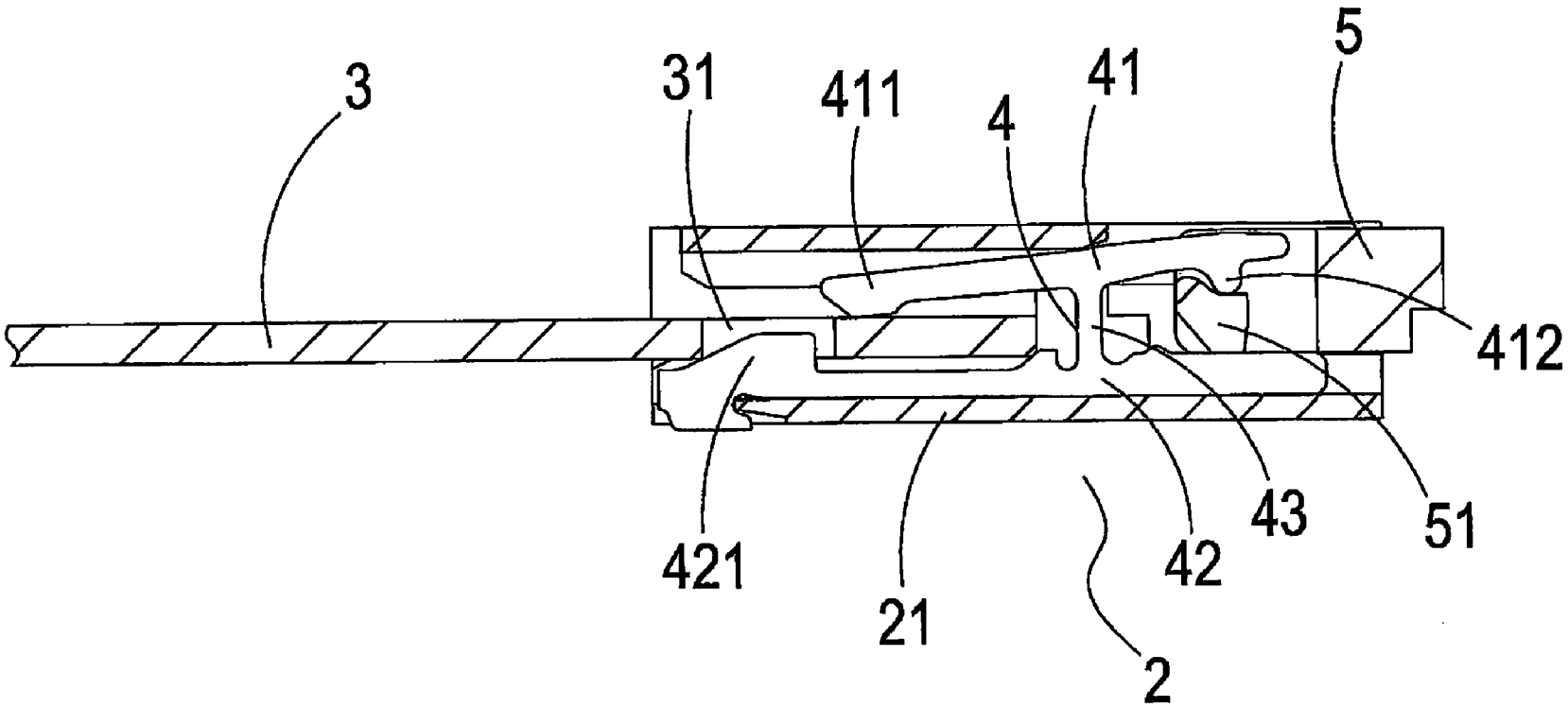
FIG. 7 shows a third schematic view of the implementation of the preferred embodiment of the present invention.

Referring to FIGS. 5 to 7, it shows a first, second and third schematic view of an implementation of the preferred embodiment of the present invention. As shown in the drawings, the connector 2 of the present invention can provide for the electric connection of the flexible circuit board 3. When the flexible circuit board 3 is to be electrically connected, the flexible circuit board 3 is inserted into the housing 21. When the flexible circuit board 3 is completely inserted into the housing 21, the pressing element 5 is pressed, allowing the pressing element 5 to be acted upon by the displacement operation to displace toward the pre-determined direction. Whereas, the abutting part 51 of the pressing element 5 can push the pushed part 412 of the movable arm 41, allowing the movable arm 41 to make the angular displacement using the connection part 43 as the pivot. The pushing part 411 will then push the flexible circuit board 3 to achieve the electric connection. In a mean time, the flexible circuit board 3 will displace downward by the compression of the pushing part 411, and the snap part 421 of the fixed arm 42 can be engaged into the latching part 31 of the flexible circuit board 3.

By the aforementioned operations, after the snap part 421 of the fixed arm 42 has been engaged into the latching part 31 at two sides of the flexible circuit board 3, if a user pulls the flexible circuit board 3 accidentally, the connector 2 can be effectively latched and fixed at the latching part 31 by the snap part 421. Accordingly, the present invention is provided with the practical progressiveness that the flexible circuit board 3 can be effectively fixed at the connector 2.

Figure 8:
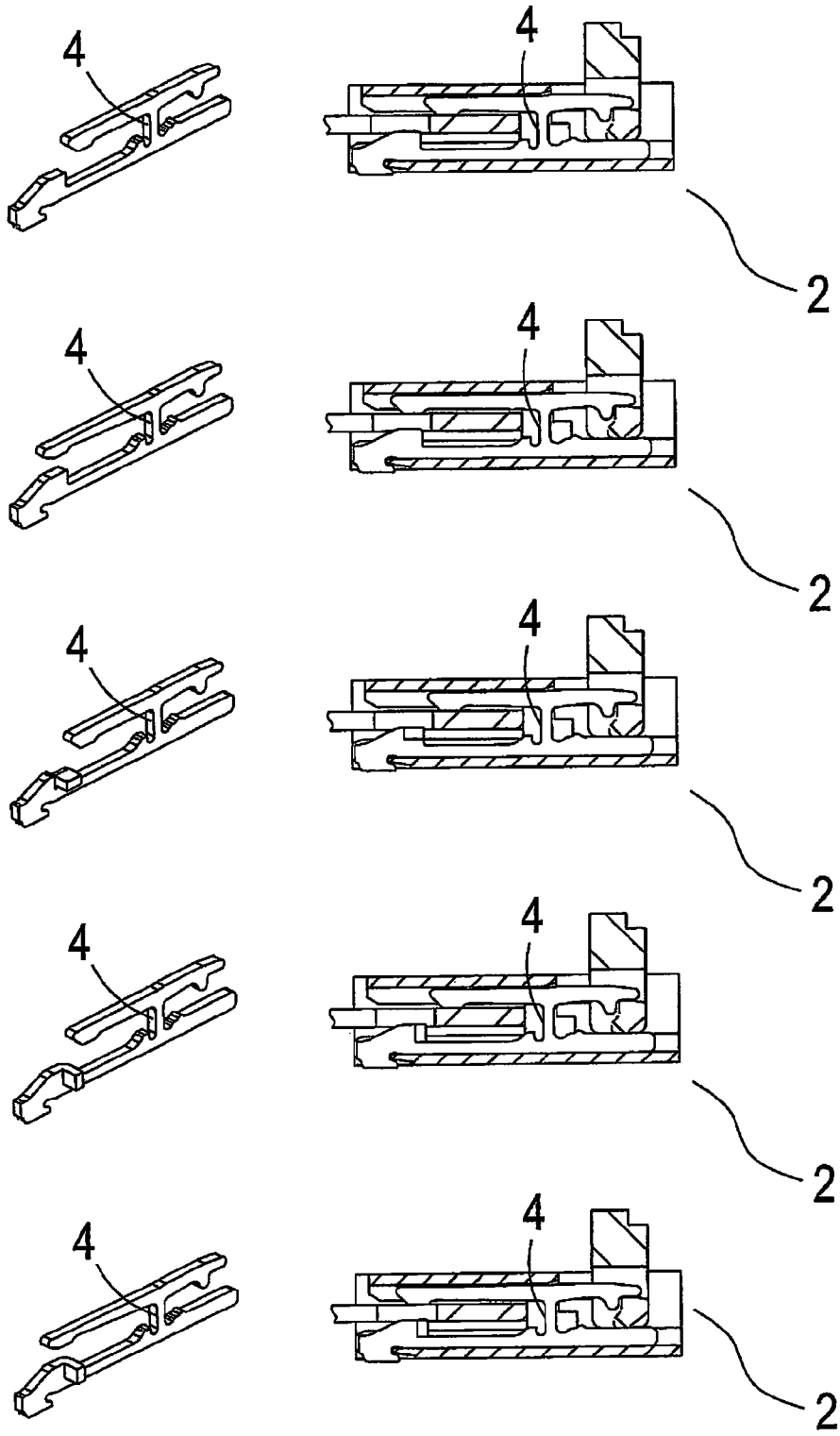
FIG. 8 shows a schematic view of an implementation of another preferred embodiment of the present invention.
Figure 9:
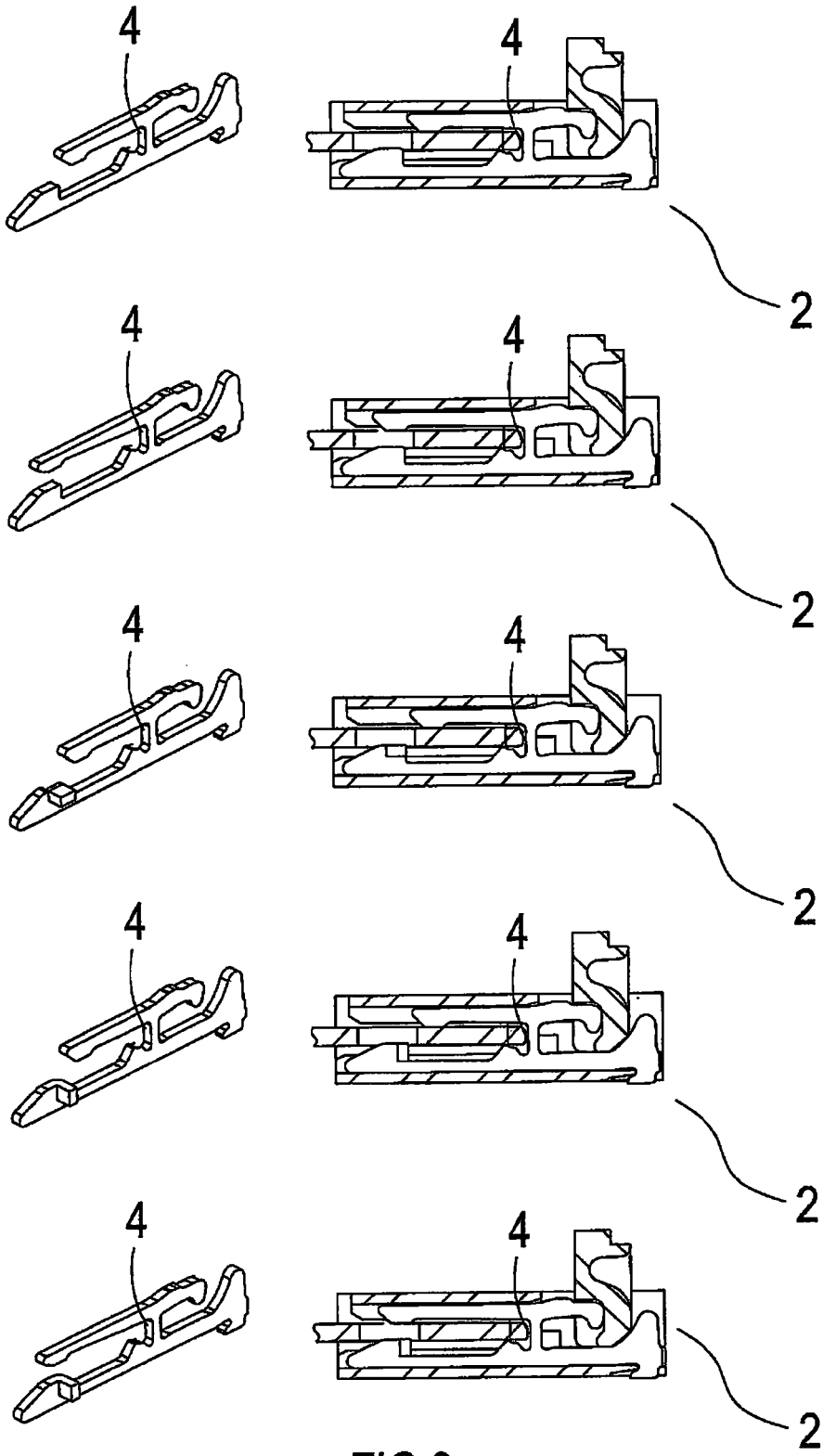
FIG. 9 shows a schematic view of an implementation of still another preferred embodiment of the present invention.

Referring to FIG. 8 and FIG. 9, it shows a schematic view of an implementation of another preferred embodiment and a schematic view an implementation of still another preferred embodiment, of the present invention. The connector 2 of the present invention can be also a variety of configuration of terminal 4 as shown in the drawings, and is still provided with the same effect of the aforementioned embodiments.

Accordingly, referring to all the drawings, the present invention is actually provided with following advantages in comparison with the prior art.

As the present invention includes the movable arm 41 and the fixed arm 42 which is provided with the snap part 421 close to the pushing part 411; whereas, the two sides of the flexible circuit board 3 are formed respectively with the latching part 31, when the pressing element 5 is acted upon by the displacement operation to displace toward the pre-determined direction, the abutting part 51 of the pressing element 5 can push the pushed part 412 of the movable arm 41, allowing the movable arm 41 to make the angular displacement using the connection part 43 as the pivot, which further enables the flexible circuit board 3 to displace downward, such that the snap part 421 of the fixed arm 42 can be engaged into the latching part 31 of the flexible circuit board 3. As a result, the flexible circuit board 3 can be more sturdily fixed at the connector 2. In addition, when the flexible circuit board 3 is inserted, the snap part 421 of the fixed arm 42 will not block the insertion of the flexible circuit board 3, which is provided with the practical progressiveness.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A connector for connecting a flexible circuit board comprising:

a housing;

said flexible circuit board which provides for electric connection with said connector and two sides of which are formed respectively with a latching part;

a terminal which is provided with a movable arm and a fixed arm, with both said arms being parallelly extended toward a same direction, wherein an end of said movable arm is provided with a pushing part and another end of said movable arm is provided with a pushed part, said fixed arm being fixed by said housing and being formed with a snap part close to said pushing part, said movable arm and said fixed arm being formed as one unit by a connection part;

a pressing element which is provided with an abutting part which is able to push said pushed part;

wherein when said flexible circuit board is to be electrically connected with said connector, said flexible circuit board is inserted into said housing, and then said pressing element is acted upon by a displacement operation to displace toward a pre-determined direction, and said abutting part of said pressing element will push said pushed part of said movable arm of said terminal thereby allowing said movable arm to make an angular displacement using said connection part as a pivot, which further enables said flexible circuit board to displace downward, such that said snap part of said fixed arm is engaged with said latching part of said flexible circuit board.

* * * * *